United States Patent [19]

Brackett et al.

[11] Patent Number: 4,900,229

[45] Date of Patent: Feb. 13, 1990

[54] AXIAL FLOW RING FAN

[75] Inventors: Stephen E. Brackett, Blenheim; Herbert N. Charles, Chatham, both of Canada

[73] Assignee: Siemens-Bendix Automotive Electronic Limited, Chatham, Canada

[21] Appl. No.: 359,241

[22] Filed: May 30, 1989

[51] Int. Cl.[4] ..... F04D 29/38

[52] U.S. Cl. ..... 416/189; 416/192

[58] Field of Search ..... 416/189 R, 192, 228 R

[56] References Cited

U.S. PATENT DOCUMENTS

| | | | |
|---|---|---|---|
| 1,518,501 | 12/1924 | Gill | 416/189 |
| 2,684,723 | 7/1954 | Faber | 416/228 |
| 3,416,725 | 12/1968 | Bohanon | 416/228 X |
| 4,358,245 | 11/1982 | Gray | 416/189 |
| 4,505,641 | 3/1985 | Tsuchikawa et al. | 416/189 |
| 4,548,548 | 10/1985 | Gray | 416/192 X |
| 4,569,631 | 2/1986 | Gray | 416/189 |
| 4,569,632 | 2/1986 | Gray | 416/189 |
| 4,684,324 | 8/1987 | Perosino | 416/189 |
| 4,768,472 | 9/1988 | Hayashi et al. | 415/119 X |

FOREIGN PATENT DOCUMENTS

| | | | |
|---|---|---|---|
| 2636056 | 2/1978 | Fed. Rep. of Germany | 416/228 |

*Primary Examiner*—Everette A. Powell, Jr.

*Attorney, Agent, or Firm*—Russel C. Wells; George L. Boller

[57] ABSTRACT

An axial flow ring fan has improved efficiency and reduced noise by making the leading edge of each blade a generally sinusoidal shape.

2 Claims, 4 Drawing Sheets

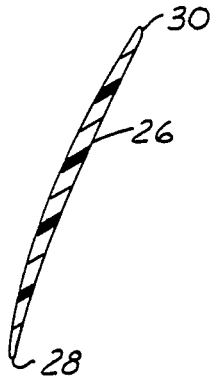
FIG.8
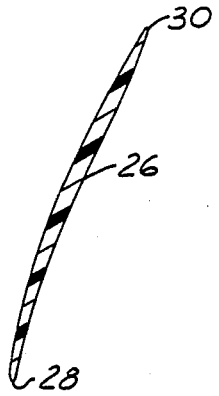
FIG.9
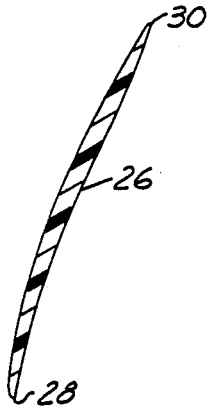
FIG.10
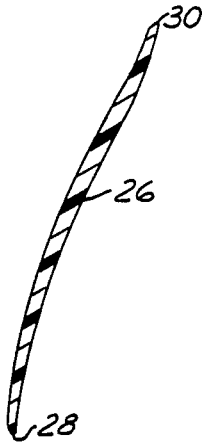
FIG.11
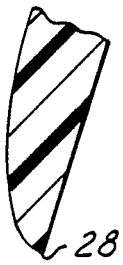
FIG.15
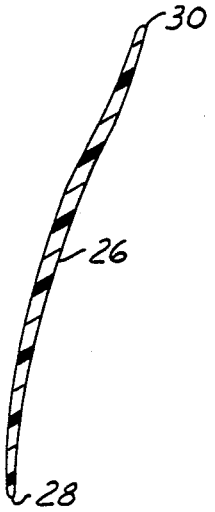
FIG.12
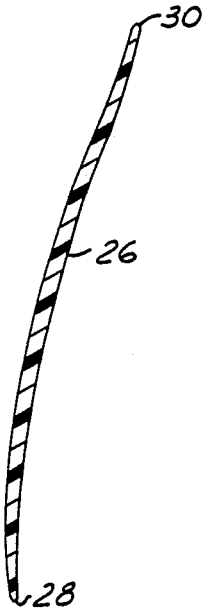
FIG.13
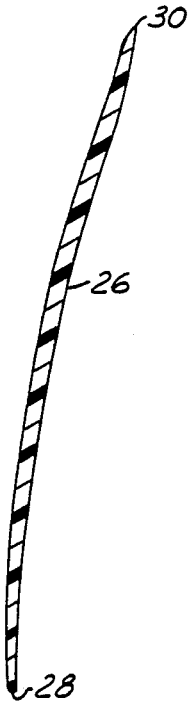
FIG.14
FIG.16
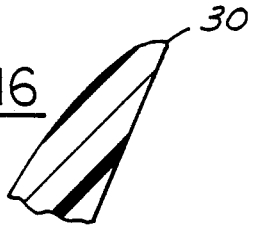

AXIAL FLOW RING FAN

BACKGROUND AND SUMMARY OF THE INVENTION

This invention relates to an axial flow ring fan and in particular to an improvement that increases the fan's operating efficiency and reduces fan noise.

Examples of known axial flow ring fans are shown in U.S. Pat. Nos. 4,358,245 and 4,569,632. The former patent shows a fan in which the blades are forwardly skewed. It is conventional practice to fabricate these fans from injection moulded plastic so that the hub, the blades, and the ring are an integral structure.

The fan of the present invention comprises forwardly skewed blades each of whose leading edge has a somewhat sinusoidal shape when viewed in the circumferential direction. This shape may be defined in terms of varying pitch ratio for the blade along the radial extent of the blade. More specifically, it may be defined in terms of the pitch ratio to average pitch ratio as a function of the blade's non-dimensional radius wherein that characteristic is substantially constant for non-dimensional radii between 0.4 and 0.495, is decreasing for non-dimensional radii between 0.495 and 0.55, is substantially constant for non-dimensional radii between 0.55 and 0.675, is increasing for non-dimensional radii between 0.675 and 0.85 and is decreasing for non-dimensional radii greater than 0.85. The pitch ratio at any particular non-dimensional radius is 6.28 times the non-dimensional radius times the tangent of angle Q where angle Q is the acute angle between a first line extending between the leading and trailing edge points of a planar projection of the cross-section of the blade along the particular non-dimensional radius and a second line that extends through the trailing edge point and is perpendicular to the direction of projection. The average pitch ratio of the blade is an average of the pitch ratios at a number of non-dimensional radii of the blade sufficient to at least approximate the actual average. In the disclosed fan the pitch ratio to average pitch ratio is approximately 1.07 for non-dimensional radii between 0.4 and 0.495, approximately 1.044 for non-dimensional radii between 0.55 and 0.675 and approximately 1.105 at a non-dimensional radius of 0.85.

A fan constructed in accordance with principles of the present invention attains an improvement in axial flow, an improvement in internal operating efficiency, and an attenuation of fan noise with a considerable reduction in rotational noise component leading to an improvement in the tonal quality of the fan. Features of the invention will be described with reference to the accompanying drawings which illustrate a presently preferred embodiment constructed in accordance with the best mode contemplated at the present time for carrying out the invention.

BRIEF DESCRIPTION OF THE DRAWINGS

FIGS. 5–14 are enlarged projected cross-sectional views taken along the respective cross-sectional lines 5 through 14 in FIG. 1.

FIG. 15 is an enlarged fragmentary view at a representative leading edge.

FIG. 16 is an enlarged fragmentary view at a representative trailing edge.

DESCRIPTION OF THE PREFERRED EMBODIMENT

Figure 1:
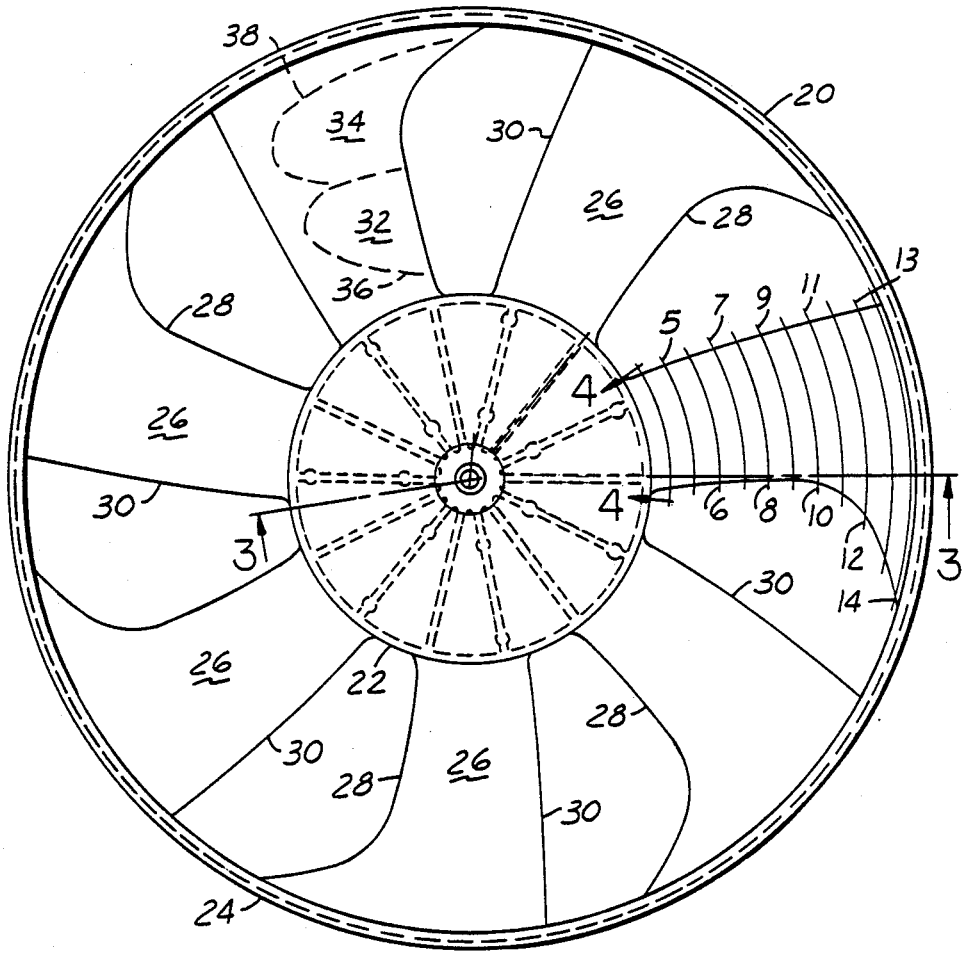
FIG. 1 is a front axial view of a fan embodying principles of the present invention.
Figure 2:
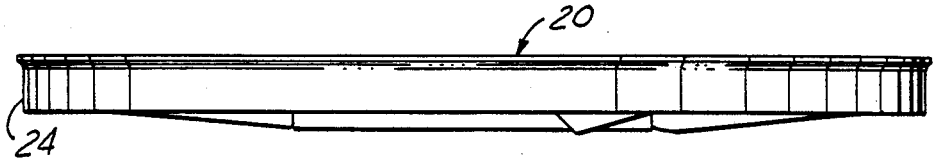
FIG. 2 is an edge view of the fan of FIG. 1.
Figure 3:
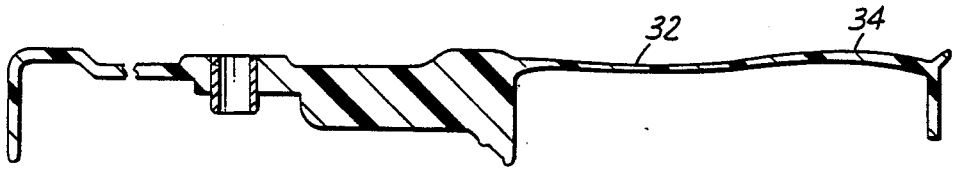
FIG. 3 is a cross-sectional view taken along line 3—3 in FIG. 1 and slightly enlarged.

FIGS. 1 and 2 show the general organization and arrangement of an axial flow ring fan 20 embodying principles of the invention. Fan 20 comprises a central hub 22, an outer ring 24, and a number of blades 26 that extend radially between hub 22 and ring 24. The blades 26 are forwardly skewed in the direction of fan rotation. The leading edges of the blades are designated 28 and the trailing edges 30. The cross-section of FIG. 3 is representative of the shape of the leading edge of each blade. As can be seen in FIG. 3 this shape is somewhat sinusoidal. It comprises an axially depressed region 32 that is radially inwardly of an axially raised region 34. As viewed axially in FIG. 1 the depressed region 32 occupies a zone approximated by the broken lines 36 while the axially raised region occupies a zone represented approximately by the broken lines 38. It is to be understood that the broken lines 36 and 38 do not represent sharp transitions but rather these zones blend smoothly into each other and into the remainder of the blade.

Figure 4:
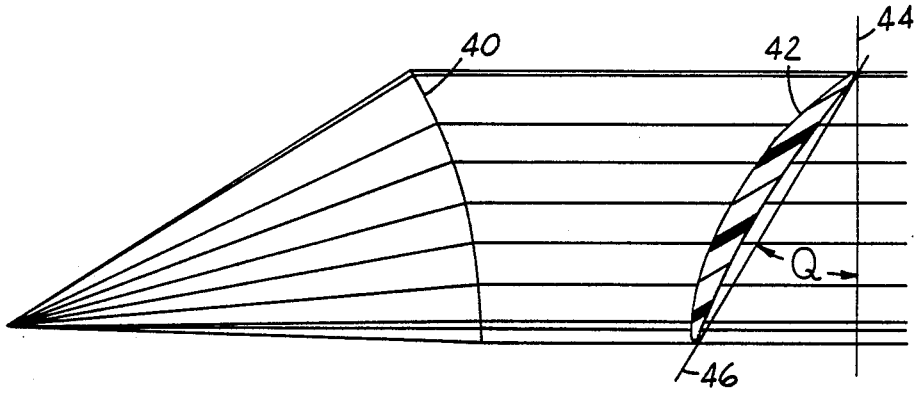
FIG. 4 is an enlarged view taken in the direction of arrows 4—4 in FIG. 1 and includes an illustration of how the cross-section is projected for purposes of defining the blade pitch.
Figure 5:
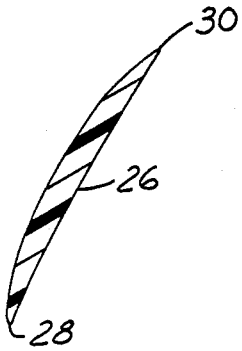
Figure 6:
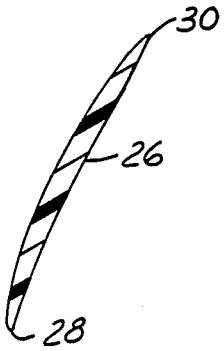
Figure 7:
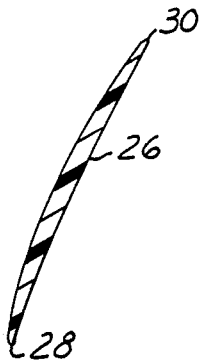
Figure 17:
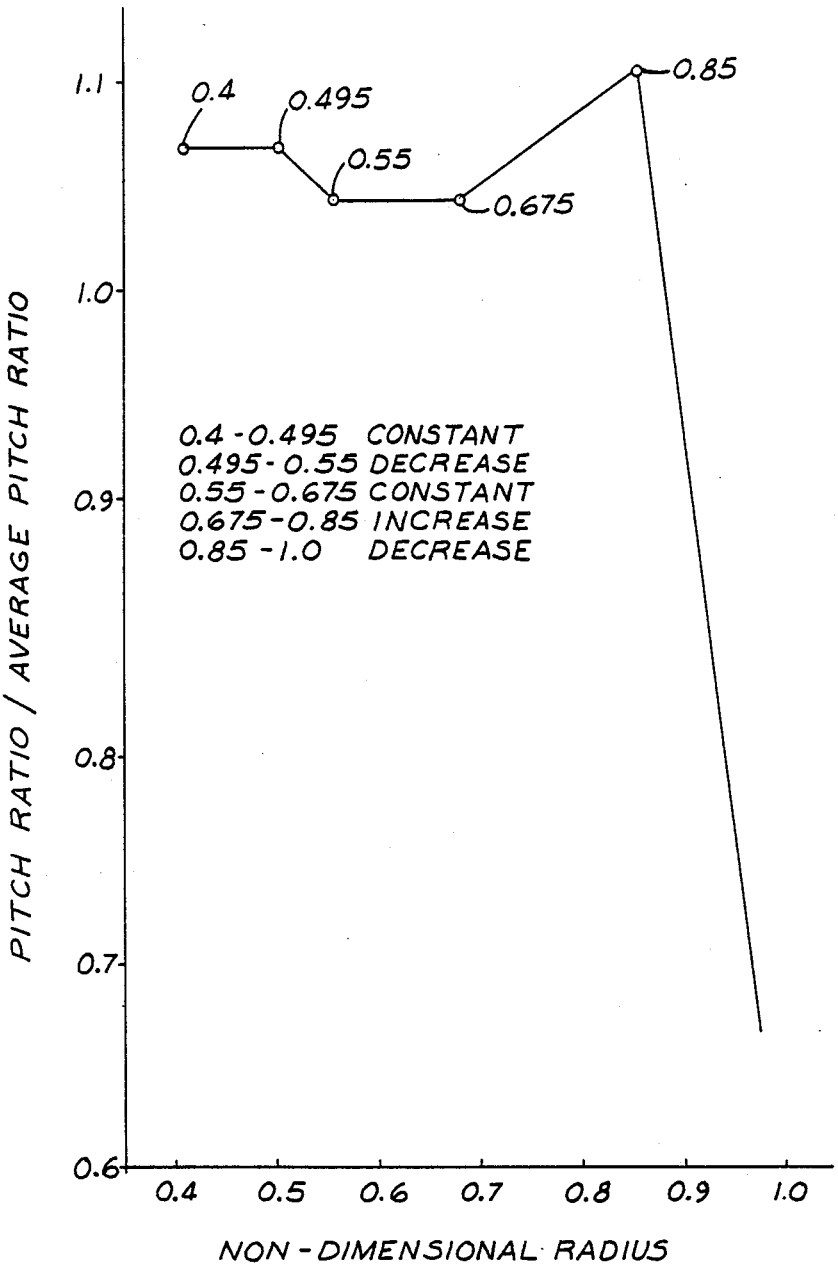
FIG. 17 is a graph illustrating the relationships involved in the fan blade.

The cross-sections depicted by FIGS. 4 through 14 are projected cross-sections taken at different radii. FIG. 4 shows how the cross-section of FIG. 4 designated by the reference numeral 40 is projected to the cross-section 42. Radii from the center of the fan are drawn to different points along the cross-section 40 and then projected perpendicular to a line 44 that extends through the trailing edge point of the cross-section. A line 46 drawn between the leading and trailing edge points of the cross-section 42 intersects line 44 to define the angle Q. The pitch ratio of any particular cross-section through the blade as represented by the cross-sections 4 through 14 is 6.28 times the non-dimensional radius of the cross-section times tangent Q. Each blade has a characteristic that is defined by the graph of FIG. 17. This figure shows the pitch ratio to average pitch ratio as a function of the non-dimensional radius of the blade. For non-dimensional radii between 0.4 and 0.495 the pitch ratio to average pitch ratio is approximately 1.07. For non-dimensional radii between 0.55 and 0.675 the pitch ratio to average pitch ratio is approximately 1.044. At a non-dimensional radius of 0.850 the pitch ratio to average pitch ratio is approximately 1.105. For non-dimensional radii between 0.495 and 0.55 the pitch ratio to average pitch ratio decreases, for non-dimensional radii between 0.675 and 0.85 it increases and for non-dimensional radii greater than 0.85 it decreases. In the actual fabrication of a fan in accordance with principles of the invention there may be a tolerance of plus or minus 0.03 for the non-dimensional radii. The average pitch ratio is an average of the pitch ratios at a number of non-dimensional radii of the blade sufficient to at least approximate the actual average pitch ratio.

What is claimed is:

1. In an axial flow ring fan that has a plurality of forwardly skewed blades extending between a central hub and an outer ring, the improvement which comprises each blade having a characteristic wherein the pitch ratio to average pitch ratio as a function of the blade's non-dimensional radius is substantially constant for non-dimensional radii between 0.4 plus or minus 0.03 and 0.495 plus or minus 0.03, is decreasing for non-dimensional radii between 0.495 plus or minus 0.03 and 0.55 plus or minus 0.03, is substantially constant for non-dimensional radii between 0.55 plus or minus 0.03 and 0.675 plus or minus 0.03, is increasing for non-dimensional radii between 0.675 plus or minus 0.03 and 0.850 plus or minus 0.03 and is decreasing for non-dimensional radii greater than 0.850 plus or minus 0.03, wherein the pitch ratio at any particular non-dimensional radius is 6.28 times the non-dimensional radius times tangent Q where Q is the acute angle between a first line extending between the leading and trailing edge points of a planar projection of the cross section of the blade along the particular non-dimensional radius and a second line that extends through the trailing edge point and is perpendicular to the direction of projection, and wherein the average pitch ratio of the blade is an average of the pitch ratios at a number of non-dimensional radii of the blade sufficient to at least approximate the actual average.

2. The improvement set forth in claim 1 in which the pitch ratio to average pitch ratio is approximately 1.07 for non-dimensional radii between 0.4 plus or minus 0.03 and 0.495 plus or minus 0.03, and is approximately 1.044 for non-dimensional radii between 0.55 plus or minus 0.03 and 0.675 plus or minus 0.03, and is approximately 1.105 at a non-dimensional radius of 0.850.

* * * * *